United States Patent [19]

Lang et al.

[11] Patent Number: 4,773,232

[45] Date of Patent: Sep. 27, 1988

[54] ADJUSTABLE FAN MOTOR MOUNT FOR A ROOM AIR CONDITIONER

[75] Inventors: Richard D. Lang, Chittenango; Theodore S. Bolton, Liverpool, both of N.Y.

[73] Assignee: Carrier Corporation, Syracuse, N.Y.

[21] Appl. No.: 123,691

[22] Filed: Nov. 23, 1987

[51] Int. Cl.[4] ..... E25D 19/00

[52] U.S. Cl. ..... 62/298; 62/262

[58] Field of Search ..... 62/298, 262; 248/645, 248/637, 646, 649

[56] References Cited

U.S. PATENT DOCUMENTS

| | | | |
|---|---|---|---|
| 2,386,883 | 10/1945 | Ames | 62/262 X |
| 2,796,745 | 6/1957 | Rose | 62/262 X |
| 2,891,389 | 6/1959 | Tull | 62/262 X |

*Primary Examiner*—Henry A. Bennett

*Attorney, Agent, or Firm*—Dana F. Bigelow

[57] ABSTRACT

The fan drive motor mount of a room air conditioner is mounted on the base pan with the edge of one U-shaped member fastened directly to the base pan and with the side walls of the other U-shaped member partially overlapping the side walls of the first member and having means to secure the two members in an adjustable manner such that the first and second members can be appropriately spaced so as to accommodate any of various sized motors.

6 Claims, 5 Drawing Sheets

ADJUSTABLE FAN MOTOR MOUNT FOR A ROOM AIR CONDITIONER

BACKGROUND OF THE INVENTION

This invention relates generally to room air conditioners and, more particularly, to motor mount apparatus which facilitates the selective adjustment of the length thereof to accommodate various motor sizes.

Room air conditioners are normally self-contained, complete systems, with both outdoor and indoor sections contained in a single chassis, and with both the outdoor and indoor sections containing a coil and a fan. It is common in these systems to use a single motor to simultaneously provide motor power to both the outdoor and the indoor fans, with connection being made to respective ends of the motor shaft. The motor is thus commonly mounted in the outdoor section, adjacent the partition dividing the indoor and outdoor sections, with one end of the motor shaft passing through the partition and into the indoor fan section, and the other end thereof having the outdoor fan mounted thereon.

One method of mounting the motor within the outdoor section has been that of mounting directly to the outdoor side of the partition. While this approach requires a relatively small amount of materials and occupies very little space, it requires that the partition be fabricated from relatively heavy material so that it is strong enough to support the motor.

Another motor mount method employed is that of supporting the motor from the base pan. With this approach, the mounting structure provides vertical support at each axial end of the motor, with the mount structure comprising two or more sections which are attached by fasteners directly to the base pan.

It is important to recognize that for any particular room air conditioner design, there may be a number of models with different capacities and different motor sizes. Further, different motor sizes generally mean different motor lengths. Thus, in accordance with the prior art approach of providing base pan mounted motors, it is necessary to stock and to use different size motor mounts to accommodate these different size motors.

It is therefore an object of the present invention to provide motor support for a room air conditioner without the need for a high strength partition wall.

Yet, another object of the present invention is the provision in a room air conditioner for a motor mount means which is readily adaptable to various size motors.

Yet another object of the present invention is the provision in a room air conditioner for a motor mounting and support system which is simple in design, easy to install, and effective in use.

These objects and other features and advantages become more readily apparent upon reference to the following description when taken in conjunction with the appended drawings.

SUMMARY OF THE INVENTION

Briefly, in accordance with one aspect of the invention, a pair of upstanding, U-shaped support members are placed on the base pan with their sides in over-lapping relationship and with their end walls facing each other. One of the members is secured directly to the base pan and the other is secured to the sides of the first member in such a manner as to allow for adjustment of the degree of overlap in order to accommodate various size motors to be suspended between the end walls of the respective members. The end walls of the members are provided with fastening means for securing the motor thereto after installation.

In the drawings as hereinafter described, a preferred embodiment is depicted; however, various other modifications and alternate constructions can be made thereto without departing from the true spirit and scope of the invention.

DESCRIPTION OF THE PREFERRED EMBODIMENT

Figure 1:
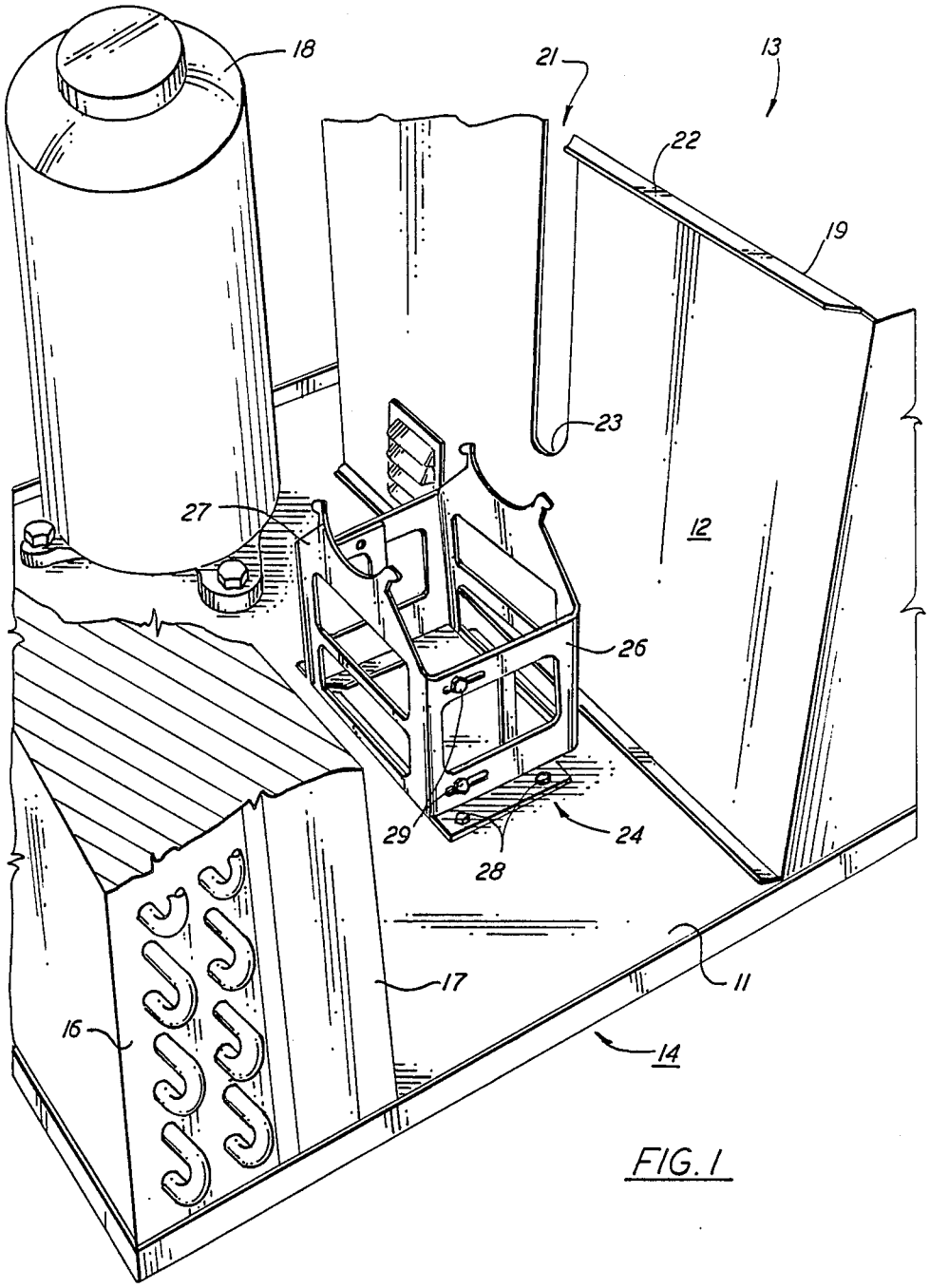
FIG. 1 is an air conditioner chassis showing the motor mount/installation assembly in accordance with the present invention.

Referring now to FIG. 1, the chassis of a room air conditioner is shown to include a base pan 11, and a partition 12 which separates an indoor section 13 from an outdoor section 14. The outdoor section 14 includes a coil 16 through which outside air is circulated by way of an outdoor fan disposed within a shroud structure 17. A compressor 18 is mounted to the base pan 11 and operates to provide the necessary energy in the refrigeration circuit in a conventional manner.

The indoor section 13 contains an evaporator coil and blower (not shown) which operate in a conventional manner to receive the relatively warm air from the room to be conditioned, cool the air as it passes through the evaporator coil, and then deliver the cool air to the room, Mounted in the indoor section 13, adjacent the partition wall 12, is a sound absorbing wall 19 which is provided to isolate the indoor section 13 from the sounds (principally from the compressor) in the outdoor section 14. Formed in the partition wall 12, and also in the sound absorbing wall 19 is a slot 21 extending downwardly from the top edge 22 of the partition wall 12 to an end point 23. The purpose of this slot 21 is to facilitate the easy installation and removal of the fan drive motor in a manner to be described hereinafter.

Located near the center of the base pan 11 is a motor mount assembly 24 comprising first and second mount members 26 and 27. The first mount member 26 is secured directly to the base pan 11 by way of fasteners 28, and the second mount member 27 is connected to the first mount member 26 by fasteners 29 in a manner which allows selective adjustment of the position of the second mount member 27 in order to accommodate various size motors between the end walls of the mount members 26 and 27.

Figure 2:
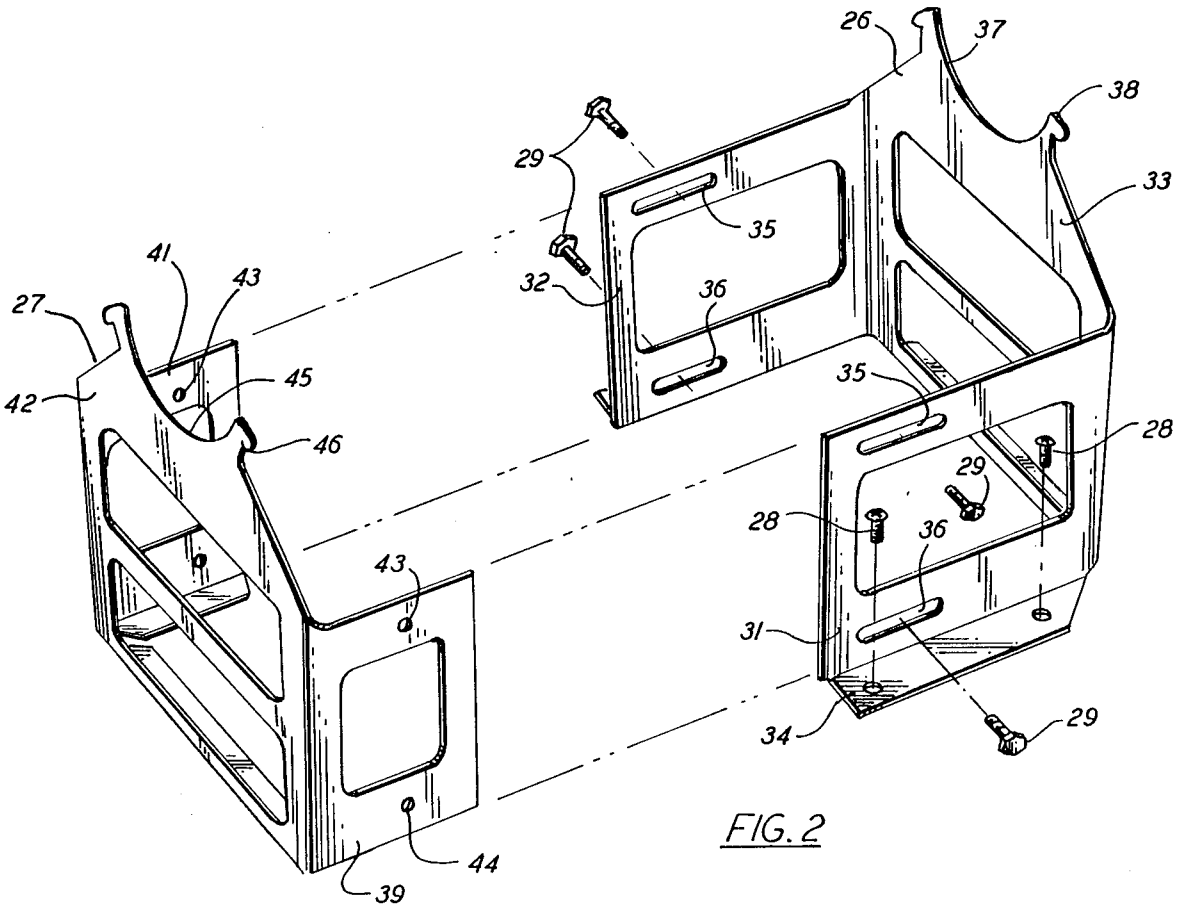
FIG. 2 is a partial enlarged view of the motor mount portion thereof.

Referring now to FIG. 2, the motor mount structure 24 is shown in exploded form. The first mount member 26 comprises upstanding side walls 31 and 32 interconnected by the upstanding end wall 33. The side walls 31 and 32 each have a bottom flange 34 extending outwardly for securing the first mount member 26 to the base pan 11. A pair of narrow, horizontally extending slots 35 and 36 are provided in each of the side walls 31 and 32 for interconnecting the second motor mount 27 to the first motor mount 26 in a manner which allows for selectively adjusting the overlap in a manner to facilitate various lengths of drive motors to be supported between the first and second motor mount members. The end wall 33 has at its upper edge a semi-circular shaped cradle structure 37 with projecting ears 38 on either side thereof. The cradle structure 37 is adapted to supportably receive one end of the drive motor thereon, and the ears 38 are adapted to receive and retain a securing clip thereon as shown in FIG. 4.

Figure 3:
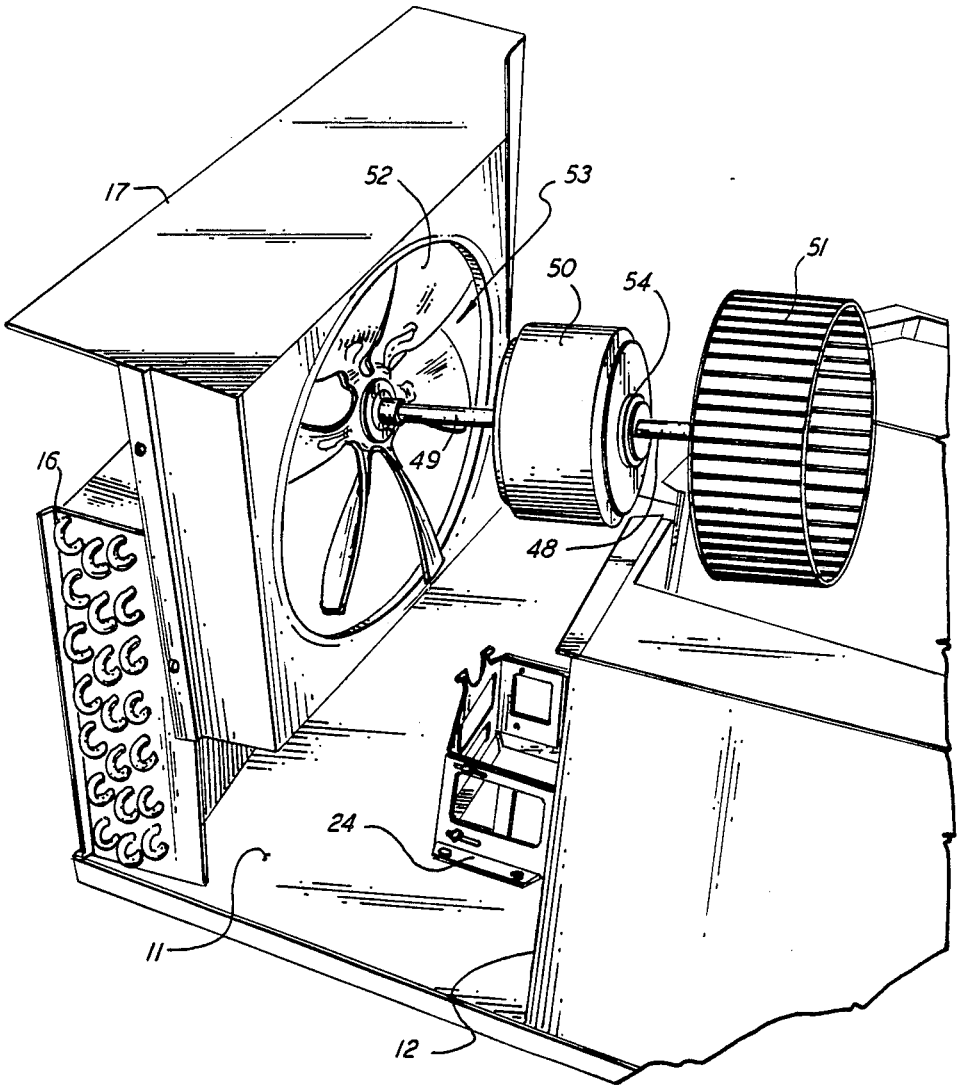
FIG. 3 is a perspective view of the motor and fan assembly in the process of installation.

The second mount member 27 includes side walls 39 and 41 interconnected by an end wall 42. The side walls contain upper and lower holes, 43 and 44, respectively, which register with the slots 35 and 36, respectively, in such a manner as to permit the selective positioning of the second mount member 27 so that the respective end walls 33 and 42 are properly spaced for a particular motor length within a range of sizes. The fasteners 29 are used to secure the second mount member 27 to the first mount member 26. Similar to the structure of the first mount member end wall 33, the end wall 42 includes a cradle structure 45 having ears 46 on either side thereof for securing the motor in place after installation Assuming now that the slot 21 has been formed in the partition wall 12, and that the motor mount assembly 24 has been secured in place and properly adjusted for the desired length between end walls, let us consider the next step in the assembly process. As shown in FIG. 3, the motor 50 includes shaft ends 48 and 49 driven by a common rotor. As part of the assembly process, a blower wheel 51 is attached to the shaft end 48, the fan shroud 17 is placed over the shaft 49, and the condenser fan 52 is connected to the shaft end 49 as shown. That assembly is then inserted into the chassis with the shaft end 48 being inserted into the slot 21 of the partition wall 12, with the blower wheel 51 being placed just forward of the partition wall 12 in substantial parallel relationship therewith. To accommodate the mounting of the motor within the mount assembly 24, a pair of vibration dampers in the form of resilient rings (e.g. molded rubber) 54 are provided at the ends of the motor 50, one being attached to the shaft end 48 and the other being attached to the shaft other end 49 as shown in FIG. 3. The rings 54 have an annular groove around their outer edges, with the rings and grooves being sized so as to fit snugly into the cradle structures 37 and 45 of the mount assembly end walls.

Figure 4:
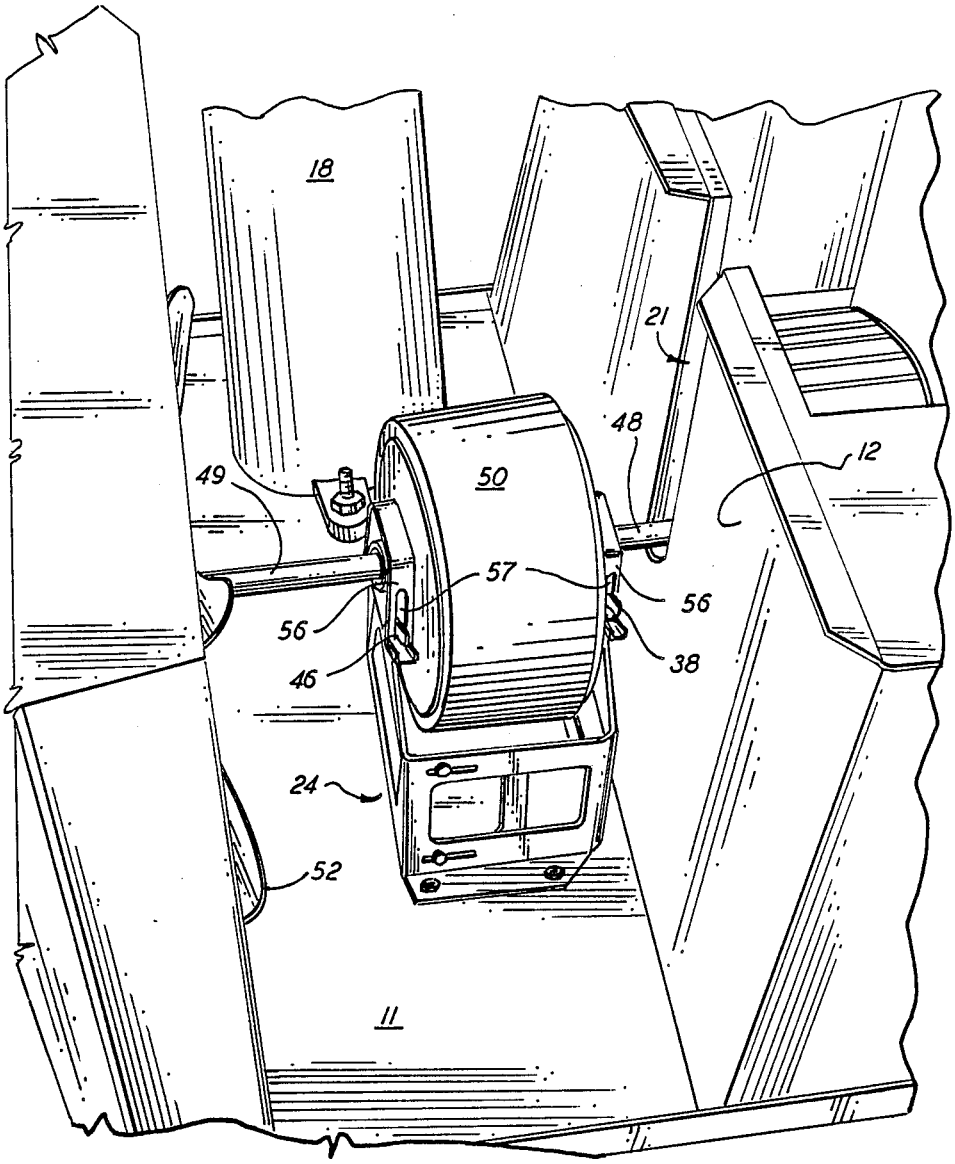
FIG. 4 is a perspective view of the motor securing clip in the process of installation.

After the motor assembly has been so installed into the mount assembly 24, a U-shaped clip 56 is installed on each end of the motor 50 as shown in FIG. 4 by slightly expanding the U-shaped clip over the ears 38 and 46, respectively until the edges of the ears fit into the openings 57 of the clip to thereby allow it to spring back to a closed position to thereby secure the motor 50 in place.

Figure 5:
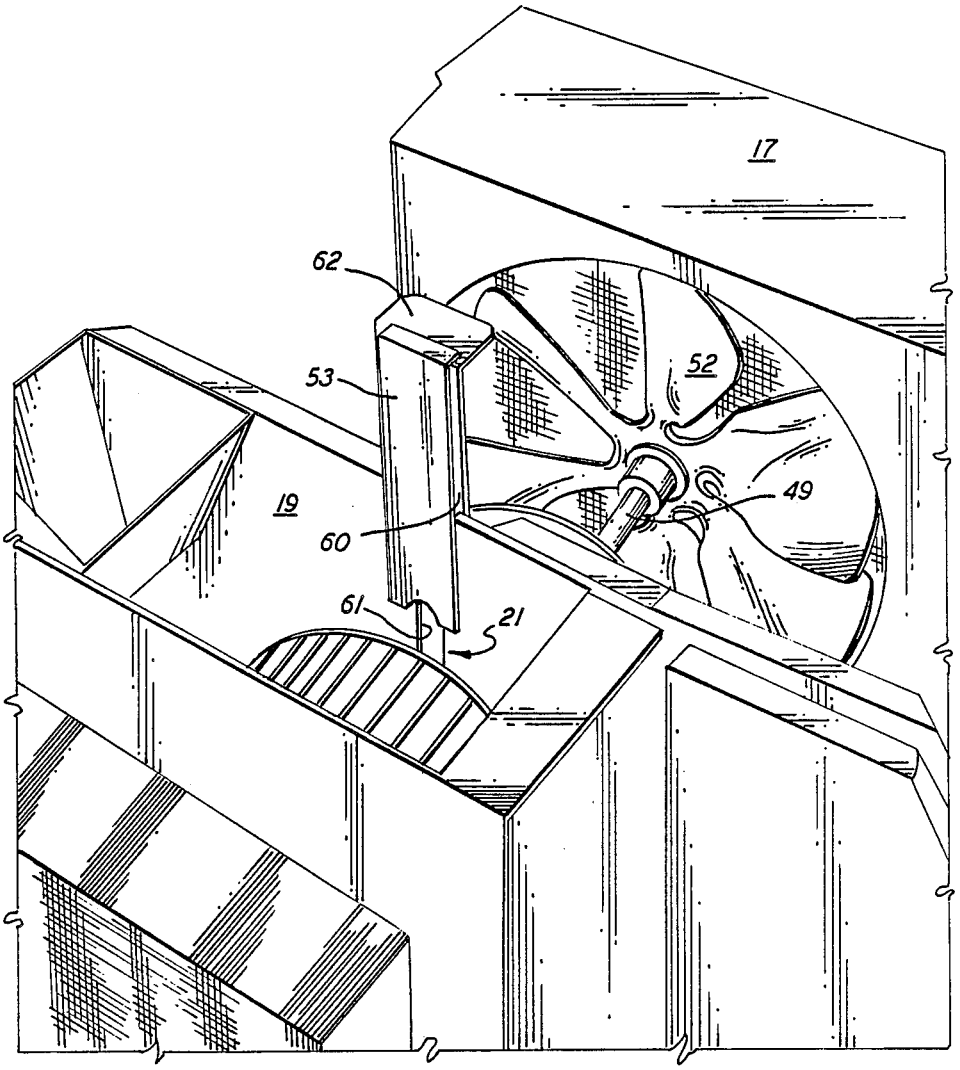
FIG. 5 is a perspective view of the filler panel in the process of assembly.

It should be recognized that the partition wall 12 functions to isolate the outdoor section from the indoor section with regard to air flow, as well as isolating the indoor section from the noise in the outdoor section. It further provides strength to the assembly. Thus, it is necessary to close the slot 21 by way of a filler plate 58 as shown in FIG. 5. The filler plate 58 is installed from the top down by sliding the grooved edges 60 over corresponding tongue shaped edges of the slot 21 until the lower edge 61 of the filler plate rests on a scroll surface at the lower edge of the slot 21. The filler plate lower edge 61 preferably includes a semi-circular form which fits closely around the motor shaft end 48. At the top end of the filler plate 58, a flange 62 is provided for connection to a reinforcement member which may be connected between the filler plate 58 and the shroud structure 17 to reinforce the assembly.

It will be recognized that the inventive structure is easily assembled as described hereinabove. It should also be recognized that disassembly can be accomplished in a very simple manner by reversing the process. In this way, a complete motor assembly may be installed or removed without disrupting either the outdoor or indoor fan and/or the indoor scroll (not shown).

While the present invention has been disclosed with particular reference to a preferred embodiment, the concepts of this invention are readily adaptable to other embodiments, and those skilled in the art may vary the structure thereof without departing from the essential spirit of the present invention.

What is claimed is:

1. A motor mount for a room air conditioner having a base pan and at least one fan to be driven by a motor, comprising:

a first mount member having attachment means for attaching it to the base pan and having upstanding side walls and an upstanding end wall, said side walls having fastener holes formed therein and said end wall having a support cradle for supportably receiving one end of the motor therein;

a second mount member having upstanding side walls and an end wall, said end wall having a support cradle for supportably receiving the other end of a motor therein and said side walls having fastener holes formed therein and said side walls being spaced so as to facilitate connection with the respective first mount member side walls, in abutting and overlapping relationship therewith;

slot means associated with said fastener holes such that said first mount member fastener holes coincide with said second mount member side wall fastener holes as the amount of overlap between said side walls is varied over a predetermined range to thereby change the distance between said first and second mount member end walls; and fastener means for interconnecting said first and second overlapping end walls at their respective fastener holes.

2. A motor mount as set forth in claim 1 and including motor mount caps to be connected to said support cradles to secure the motor in place.

3. A motor mount as set forth in claim 1 wherein said slot means comprises a horizontal slot formed in each of said first mount member side walls.

4. A motor mount as set forth in claim 1 and including resilient rings associated with each end of the motor shaft, said rings fitting directly into said end wall support cradles.

5. In an air conditioner of the type having outdoor and indoor coils and fans mounted on a base pan, and containing a motor for driving the indoor fan, a motor mount apparatus comprising:

a first mount member having a bottom flange for attachment to the base pan, a pair of spaced upstanding side walls with each having a hole for passing a fastener therethrough, and an end wall with an upper cradle structure for supportably receiving one end of a motor shaft thereon;

a second mount member having a pair of spaced upstanding side walls, with each having a hole for passing a fastener therethrough, and each being placed adjacent one of said first mount member side walls, in partial overlapping relationship therewith, and an end wall with an upper cradle structure for supportably receiving one end of a motor shaft thereon;

fastening means associated with said first and second mount member side wall holes and including at least one slot in each combination of overlapping first and second side walls, and a fastener for connecting each of said combinations such that the amount of overlap, and thus the distance between said first and second cradle structures, can be varied.

6. A motor mount apparatus as set forth in claim 5 and including cap means for securing said motor shaft ends to said cradle structures.

* * * * *